United States Patent [19]

Miller

[11] 4,399,027

[45] Aug. 16, 1983

[54] FLOTATION APPARATUS AND METHOD FOR ACHIEVING FLOTATION IN A CENTRIFUGAL FIELD

[75] Inventor: Jan D. Miller, Salt Lake City, Utah

[73] Assignee: University of Utah Research Foundation, Salt Lake City, Utah

[21] Appl. No.: 182,524

[22] Filed: Aug. 29, 1980

Related U.S. Application Data

[63] Continuation-in-part of Ser. No. 94,521, Nov. 15, 1979, Pat. No. 4,279,743.

[51] Int. Cl.[3] ..... B03D 1/02; B03D 1/14

[52] U.S. Cl. ..... 209/164; 209/168; 209/211

[58] Field of Search ..... 209/12, 18, 144, 164, 209/170, 211, 168, 173; 210/512.1, 788

[56] References Cited

U.S. PATENT DOCUMENTS

| | | | |
|---|---|---|---|
| 2,354,311 | 7/1944 | Harlow | 209/144 |
| 2,879,889 | 3/1959 | Rakowsky | 209/173 |
| 3,130,157 | 4/1964 | Kelsall et al. | 209/211 X |
| 3,219,186 | 11/1965 | Polhemus et al. | 209/211 X |
| 3,349,548 | 10/1967 | Boyen | 209/211 X |
| 3,391,787 | 7/1968 | Salomon | 210/512.1 X |
| 3,489,680 | 1/1970 | Snaxely, Jr. | 210/512.1 X |
| 3,557,956 | 1/1971 | Braun et al. | 162/4 X |
| 3,615,008 | 10/1971 | Alpha | 209/144 X |
| 3,759,385 | 9/1973 | Pouillon | 209/168 X |
| 4,208,276 | 6/1980 | Bahr | 209/168 |
| 4,216,095 | 8/1980 | Ruff | 209/211 X |

FOREIGN PATENT DOCUMENTS

| | | | |
|---|---|---|---|
| 2748478 | 5/1978 | Fed. Rep. of Germany . | |
| 1022375 | 3/1953 | France . | |
| 2263036 | 3/1975 | France . | |
| 1005479 | 9/1965 | United Kingdom . | |
| 1177176 | 1/1970 | United Kingdom . | |
| 1500117 | 2/1978 | United Kingdom . | |
| 545385 | 3/1977 | U.S.S.R. | 209/170 |
| 751437 | 7/1980 | U.S.S.R. | 209/168 |

*Primary Examiner*—Ralph J. Hill

*Attorney, Agent, or Firm*—H. Ross Workman; Allen R. Jensen; Dale E. Hulse

[57] ABSTRACT

A gas-sparged hydrocyclone apparatus and method for achieving separation by flotation in a centrifugal field. The hydrocyclone apparatus is suitably modified so that a gas phase may be dispersed into the liquid vortex created in the hydrocyclone.

20 Claims, 5 Drawing Figures

FLOTATION APPARATUS AND METHOD FOR ACHIEVING FLOTATION IN A CENTRIFUGAL FIELD

RELATED APPLICATIONS

This application is a continuation-in-part application of my copending application Ser. No. 094,521 filed Nov. 15, 1979 for AIR-SPARGED HYDROCYCLONE AND METHOD, which issued as U.S. Pat. No. 4,279,743 on July 21, 1981.

BACKGROUND

1. Field of the Invention

This invention relates to a novel flotation apparatus and method and, more particularly, to a novel flotation apparatus and method for achieving flotation in a centrifugal field.

2. The Prior Art

Flotation—General Discussion

Flotation is a process in which the apparent density of one particulate constituent of a suspension of divided particles is reduced by the adhesion of gas bubbles to that respective particulate constituent. The buoyancy of the bubble/particle aggregate is such that it rises to the surface and is thereby separated by gravity from the remaining particulate constituents, which do not attract air, and which, therefore, remain suspended in the liquid phase. The preferred method for removing the floated material is to form a froth, or foam, to collect the bubble/particle aggregates. The froth with collected bubble/particle aggregates is removed from the top of the suspension. This process is called froth flotation and is conducted as a continuous process in equipment called flotation cells. Importantly, froth flotation is favored by copious quantities of small, one to two millimeter bubbles.

Conventionally, the success of flotation depends on controlling conditions in the suspension so that air is selectively retained by one constituent and rejected by the others. To attain this objective, the pulp must be treated by the addition of small amounts of known chemicals which render one constituent floatable with respect to the remaining constituents. Thus, a complete flotation process is conducted in several steps: (1) the feed is ground, usually to a size less than about 28 mesh; (2) a slurry containing about 5 to 40 percent solids in water is prepared; (3) the necessary chemicals are added and sufficient agitation and time provided to distribute the chemicals on the surface of the particles to be floated; (4) the treated slurry is aerated in a flotation cell by agitation in the presence of a stream of air or by blowing air in fine streams through the pulp; and (5) the aerated particles in the froth are withdrawn from the top of the cell as a froth product (frequently as the concentrate) and the remaining solids and water are discharged from the bottom of the cell (frequently as the tailing product).

Chemicals useful in creating the froth phase for the flotation process are commonly referred to as frothers. The most common frothers are short chain alcohols such as methyl isobutyl carbinol, pine oil, cresylic acid, and the like. The criteria for a good frother revolves around the criteria of solubility, toughness, texture, froth breakage, and non-collecting techniques. In practical flotation tests, the size, number, and stability of the bubbles during flotation may be optimized at given frother concentrations.

Much scientific endeavor has been expended toward analyzing the various factors which relate to improving the conditions during flotation for improved recovery of particles. One particular phenomenon that has been known for some time is the poor flotation response of fine particles. For example, the state of the art is adequately described in FIG. 1 wherein a comparison is made of the percentage of recovery from specified size fractions versus the average particle size for the conventional flotation of certain sulfide minerals. It will be noted that below about ten microns, there is an abrupt drop in the percentage of recovery of these fine particles. In particular, FIG. 1 illustrates size-by-size recovery curves for a variety of sulfide minerals. Each curve is the result of a one minute float of a full flotation size range in a timed batch test (60 seconds), each test being carried out so far as is possible under the same flotation conditions (i.e., conditioning and flotation which would lead to good recovery of intermediate size particles after several minutes flotation time). The difference in coarse particle recovery between galena and pyrite might be explained by the density differences between the minerals (7500 and 5000 kg/m, respectively); however, the same explanation cannot be offered in the case of pentlandite which has nearly the same density as pyrite. It is important to note from FIG. 1 that there is a marked decrease in recovery percentage for these sulfide minerals at particle sizes less than about 15 microns and further that this effect is recognized to be generally true for all particle types.

Basically, surface chemical factors determine the potentiality for formation of a bubble/particle aggregate. The qualitative interrelationships between hydrophobicity, contact angle, and flotation response are fairly well understood but there is little quantitative information available on the relationship between hydrophobicity and induction time. Induction time can be defined as the time taken for a bubble to form a three-phase contact at a solid surface after initial bubble/particle collision. Alternatively, it can be regarded as the time taken after collision for the liquid film between a particle and bubble to thin to its rupture thickness. Induction times which are characteristics of good flotation conditions are known to be of the order of 10 milliseconds. However, whereas contact angle appears to be an intrinsic characteristic of the surface chemical forces, in an actual flotation system, induction time besides being dependent on surface chemical forces, is additionally contingent on physical factors such as particle size, temperature in some circumstances, and also, because of its nature, presumably on inertial effects. Consequently, in considering bubble/particle contact and adhesion, any calculations involving an induction time factor must to some extent be speculative, but nevertheless may provide a useful guide to the significance of that factor on affecting flotation rates and the general flotation response of any particle.

Additional discussions relating to flotation and fine particles processing may be found in the publications:

*Flotation,* vols. 1 and 2 M. C. Furstenau, editor, American Institute of Mining, Metallurgical, and Petroleum Engineers, Inc., New York, N.Y., 1976; and

*Fine Particles Processing,* Proceedings of the International Symposium on Fine Particles Processing, Las Vegas, Nev., Feb. 24–28, 1980 (vols. 1 and 2; P. Somasundaran, editor, American Institute of Mining, Metallurgical, and Petroleum Engineers, Inc., New York, N.Y., 1980.

In addition to conventional froth flotation, variations in flotation techniques include the addition of an emulsion of oil. For example, the separation of coal is greatly assisted by the addition of about three to five percent or more oil to enhance the formation of oil droplet/coal particle aggregates. A slurry of ground coal is flocculated with the oil and the flocs which float are separated from the refuse material by skimming from the surface. While this technique does not utilize air bubbles for flotation, the adaptation of this system to froth flotation has been used both for coal and a variety of ores such as manganese dioxide and ilmenite (an oxide mineral of iron and titanium). In this latter process, a collector and fuel oil are added to the ore slurry, often with an emulsifier. The conditions of the process are adjusted so that when the pulp is aerated, the dispersed oil/particle suspension inverts from that of oil-in-water in the pulp to one of water-in-oil in the froth. This process, therefore, occupies a middle position between froth flotation and the foregoing oil flotation process. Advantageously, the quantity of oil used is usually much lower than that used for the bulk oil or spherical agglomeration process, generally only one to several pounds of oil per ton of ore processed. The modifications of conventional froth flotation are referred to in the art as emulsion or oil flotation.

Since for effective aeration the particles should be small and the original density of the floated material is not too critical, flotation can be applied where conventional gravity separation techniques fail. Indeed, so successful and versatile has flotation become that it has supplanted the older gravity separation methods in a number of separation problems. Originally, flotation was used to separate sulphide ores of copper, lead and zinc from associated gangue mineral particles but is also used for concentrating nonsulphide ores, for cleaning coal, for separating salts from their mother liquors, and for recovering elements such as sulphur and graphite.

Cyclonic Separators—General Discussion

The cyclonic separator or hydrocyclone is a piece of equipment which utilizes fluid pressure energy to create rotational fluid motion. This rotational motion causes relative movement of particles suspended in the fluid thus permitting separation of particles, one from another or from the fluid. The rotational fluid motion is produced by tangential injection of fluid under pressure into a vessel. The vessel at the point of entry for the fluid is usually cylindrical and can remain cylindrical over its entire length though it is more usual for it to become conical. In many instances, the hydrocyclone is used successfully for dewatering a suspension or for making a size separation (classifying hydrocyclone). However, equally important is its use as a gravity separator. Hydrocyclones have been used extensively as gravity separators in coal preparation plants and design features have been established for such applications which emphasize the difference in particle gravity rather than the differences in particle size. Two general categories of hydrocyclones used for gravity separation can be distinguished by their design features particularly with respect to their feed and discharge ports and, to a lesser extent, by the presence or absence of a conical section.

The first type of hydrocyclone generally has three inlet and outlet ports and consists of a cylindrical vessel ranging, as found in industry, from 2 to 24 inches in diameter with a conical or bowl-shaped bottom. Variations exist in the shape, dimensions, bottom design, vortex finder, etc. Choice of the various parameters of the cyclone depend upon the size of the particles to be treated and the efficiency desired. Thus, the major operating variables of the hydrocyclone are: the vertical clearance between the lower orifice edge of the vortex finder and the cyclone bottom; vortex finder diameter; apex diameter; concentration of feed solids; and inlet pressure.

In operation, the particle/water slurry is introduced tangentially and under pressure into the cylindrical section of the cyclone where centrifugal force acts on the particles in proportion to their mass. As the slurry moves downward into the conical section of the cyclone, the centrifugal force acting on the particles increases with decreasing radii. In such a regime, the heavy density particles of a given size move outward toward the descending water spiral much more rapidly than their lighter density counterparts. Consequently, as these lighter density particles approach the apex of the cone, they are drawn into an upwardly flowing, inner water spiral which envelopes a central air core and these lighter density particles report to the vortex finder as overflow product. The heavier particles in the outer spiral along the cyclone wall report to the apex orifice of the hydrocyclone as an underflow product. Admittedly, this is an oversimplified description of the separation affected in a hydrocyclone which is, in fact, a very complex interaction of many physical phenomena including centrifugal acceleration, centripetal drag of the fluid, and mutual impact of particles.

The second type of hydrocyclone used for gravity separation has four inlet/outlet ports and consists of a straight-wall cylindrical vessel of specified length and diameter and is usually operated at various inclined positions ranging between the horizontal and the vertical. A suspension of particles enters the vessel through a coaxial feed pipe, generally at the upper end of the vessel, while a second fluid, water or a heavy media suspension, enters the vessel tangentially, under pressure, through an inlet adjacent the lower end of the vessel. The pumped medium thus introduced creates a completely open vortex within the vessel as it transverses the vessel toward a tangential sink discharge adjacent the upper or inlet end. The cyclonic action created in the vessel transports the heavier particles to the sink discharge while the lower density particles are removed from the vessel through a coaxial outlet (vortex finder) at the lower end of the vessel.

Either of the foregoing devices can be used with or without dense media. Hydrocyclones used without dense media for gravity separations are referred to as water-only hydrocyclones and those that are used with dense media are referred to as heavy media hydrocyclones. The dense media usually consists of an aqueous suspension of finely ground magnetite or ferrosilicon to control the specific gravity of the media between the specific gravities of the two components of the feed material. The finely ground media material is recovered from both the overflow and the underflow streams by screening and recycling. This requirement adds to the cost and complexity of the separation and limits the process with respect to the size of particles which can be separated.

Additional information regarding hydrocyclone separators and their operation may be found in the following publications:

*The Hydrocyclone,* D. Bradley, Pergamon Press, Oxford, 1965;

"Performance of the Hydrocyclone as a Fine-Coal Cleaner", P. Sands, M. Sokaski, and M. R. Geer, Bureau of Mines Report of Investigations, 7067, United States Department of the Interior, January 1968;

"Performance Characteristics of Coal-Washing Equipment; Dense-Medium Cyclones", A. W. Deurbrouck and J. Hudy, Jr., Bureau of Mines Report of Investigations, 7673, United States Department of the Interior, 1972;

"Performance Characteristics of Coal-Washing Equipment; Hydrocyclones", A. W. Deurbrouck, Bureau of Mines Report of Investigations, 7891, United States Department of the Interior, 1974; and "Water-Only Cyclones; Their Functions and Performance", E. J. O'Brien and K. J. Sharpeta, *Coal Age,* pgs. 100–114, January 1976.

Surprisingly, it has been discovered that flotation can be accomplished in a centrifugal field for improved efficiencies in the recovery of particles particularly with respect to those particles which are conventionally considered too small to be recovered by gravity separators and which do not respond well in conventional froth flotation systems in a gravitational field. Such an apparatus and method is disclosed and claimed herein.

BRIEF SUMMARY AND OBJECTS OF THE INVENTION

The present invention relates to a novel flotation apparatus and method whereby the flotation is achieved in the centrifugal field of a hydrocyclone device. The apparatus is configurated as any one of a variety of suitable, conventional cyclonic separators which has been suitably modified to accomodate the novel method of this invention. Air for the flotation separation technique may be supplied either through a porous wall in the cyclonic device or by means of air dispersed into a medium introduced into the cyclonic device.

It is, therefore, a primary object of this invention to provide improvements in gravity and flotation separation techniques.

Another object of this invention is to provide an improved hydrocyclone useful as a flotation device.

Another object of this invention is to provide improvements in flotation techniques.

Another object of this invention is to provide an improved hydrocyclone having a porous wall surrounding a portion of the body of the hydrocyclone, the porous wall forming a part of the wall for an air plenum and serving to introduce air into the hydrocyclone.

Another object of this invention is to provide an improved apparatus for introducing finely dispersed air bubbles within a liquid media for a cyclonic separator and thereby provide the necessary froth phase for flotation in a centrifugal field.

These and other objects and features of the present invention will become more fully apparent from the following description and appendent claims taken in conjunction with the accompanying drawing.

DETAILED DESCRIPTION OF THE PREFERRED EMBODIMENTS

Figure 1:
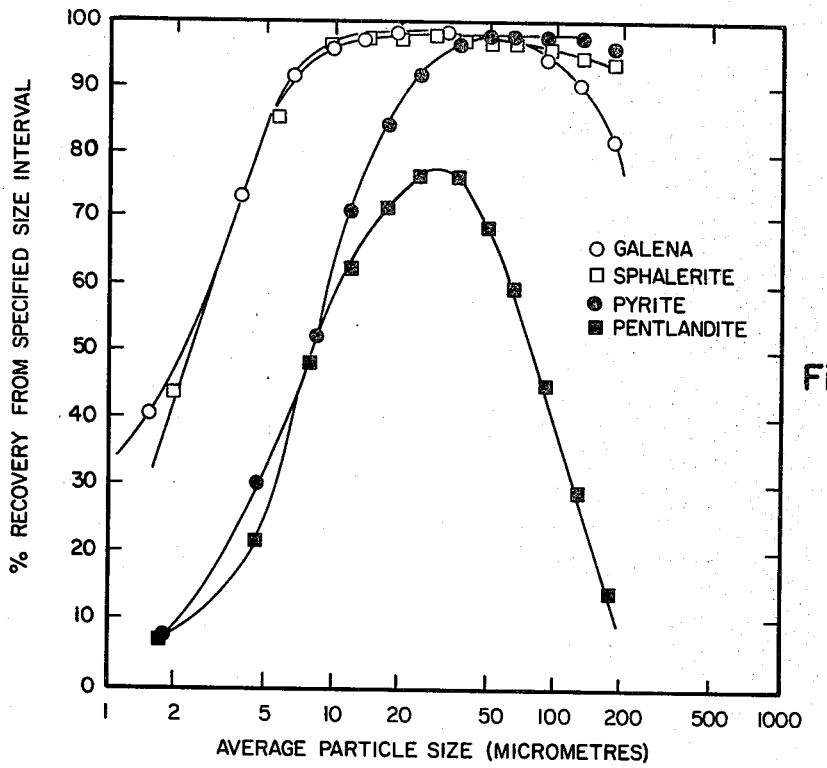
FIG. 1 is a chart comparing the percentage of recovery from specified size intervals with the average particle size of these intervals for various minerals using standard flotation techniques.

The invention is best understood by reference to the drawing wherein like parts are designated with like numerals throughout.

GENERAL DISCUSSION

From the foregoing prior art publications, and as a result of the various observations which are significant in relation to the flotation of fine particles (less than approximately 15 micrometers), the following equation has been reported for fine particles to explain their flotation response. Advantageously, the equation offers clues to methods of improving the rate of flotation of fines. The rate constant, k, is expressed as:

$$k = 3\pi\beta aruN\operatorname{sech}^2\left(\frac{3u\lambda}{4a}\right) \qquad \text{Equation (1)}$$

Where ($\beta$) is the proportion of particles retained in the froth after fruitful collision; (a), is the radius of the bubble, radius of curvature; (r), is the particle radius; (u), is the relative particle bubble velocity; (N), is the number of bubbles per unit volume of pulp; ($\lambda$), is the induction time. Inherent in ($\lambda$) are the numerous chemical factors endowing the mineral surface with appropriate hydrophobic character. All the other terms relate to the physical environment in a flotation cell, especially concerning the gas phase; (a), bubble radius or bubble size; (N), bubble concentration; and (u), relative bubble/particle velocity. The increase in flotation rate arising from an increase in aeration rate (N), is well-known.

On first inspection, it would appear that the form of the equation would seem to predict that the rate constant, k, would increase as bubble size increases. However, researchers have pointed out that these predictions tend to contradict practical observations. There is a common factor that has not been stressed in any of the foregoing arguments; that is the simultaneous change in both bubble number, (N), and the average bubble velocity, (u), which will occur in a real flotation system if any step is taken to adjust average bubble size. The foregoing Equation 1 indicates how all these factors are simultaneously involved and a "bubble factor", B, can be isolated from the rate constant equation as follows:

$$B = auN\text{sech}^2\left(\frac{3\lambda u}{4a}\right) \quad \text{Equation (2)}$$

Table I presents bubble size, velocity, number, etc., for a specified flotation system (i.e., 10.5 percent air by volume in the pulp; 200 bubbles of one millimeter diameter per cubic centimeter of pulp). Attention is particularly directed to the large increase in the "bubble factor" and thus, flotation rate constant, as bubble size decreases. This increase is seen to rise mainly from the large increase in bubble numbers which completely masks the opposing size and velocity effects.

TABLE I

Change in 'Bubble Factor' with Bubble Size at Constant Bubble Concentration ($\lambda$ = 0.0094 sec)

| Bubble Diam. (2a) (cm) | Bubble Velocity (u) (cm/sec) | N | $\text{sech}^2\left(\frac{3\lambda u}{4a}\right)$ | B |
|---|---|---|---|---|
| 0.15 | 15.5 | 60 | 0.195 | 13.4 |
| 0.10 | 10.2 | 200 | 0.202 | 20.6 |
| 0.06 | 5.5 | 926 | 0.261 | 39.8 |
| 0.05 | 4.4 | 1600 | 0.285 | 50.1 |
| 0.04 | 3.5 | 3125 | 0.288 | 63.0 |
| 0.03 | 2.4 | 7407 | 0.343 | 91.5 |
| 0.02 | 1.3 | 25000 | 0.475 | 154.5 |
| 0.01 | 0.45 | 200000 | 0.685 | 308.3 |

While theory confirms generally held opinions among metallurgists that any measure which can be adopted to reduce bubble size will aid flotation, it has been observed that recovery is very poor in a flotation column using very fine bubbles. In general, designers of industrial flotation cells do not appear to have produced a satisfactory solution to the problem of producing fine bubbles economically and then using them efficiently.

However, the radial flow of fine gas bubbles in a centrifugal field of about 80 G results in bubble velocities on the order of 1600 cm/sec. Such conditions are especially well-suited for the flotation of fine particles and should extend the fine size limit for flotation in many systems. In addition, the use of an air-sparged hydrocyclone for coal cleaning is believed to be an excellent application and experimental results demonstrate its effectiveness in ash rejection compared to traditional flotation separation in a gravitational field. Experimental results for other mineral systems also indicate similar success can be realized even for systems in which the gravity differential would not generally be favorable for the separation.

Figure 2:
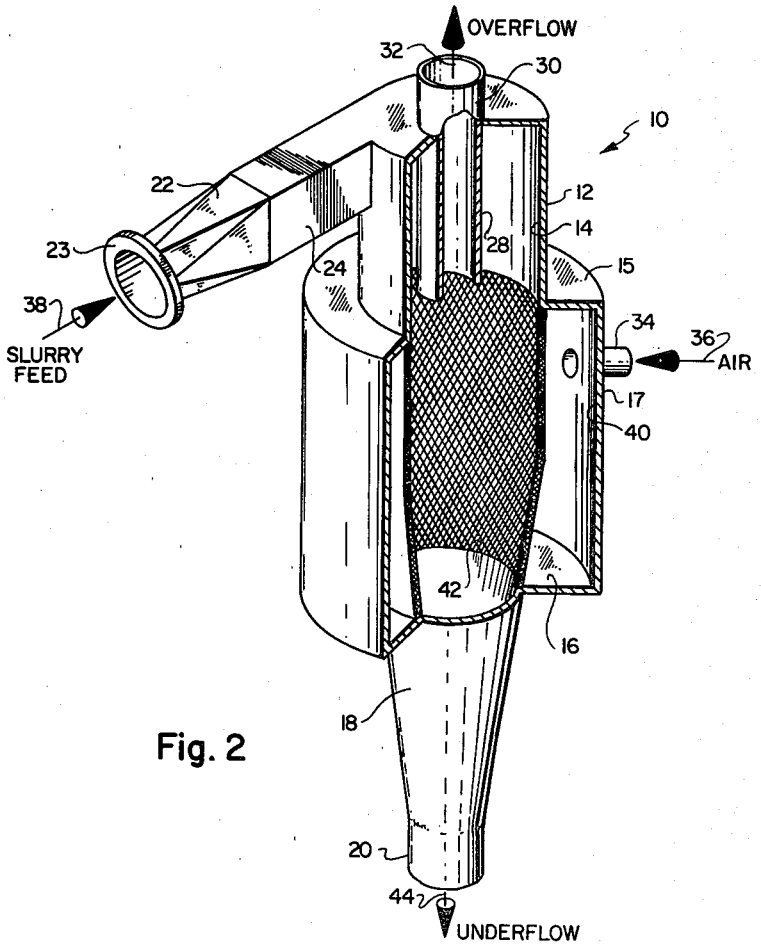
FIG. 2 is a perspective view of a first preferred embodiment of the novel apparatus of this invention for obtaining flotation in a centrifugal field with portions broken away to reveal internal construction and operation.

The Embodiment of FIG. 2

Referring now more particularly to FIG. 2, a first preferred embodiment of the novel apparatus of this invention for achieving flotation in a centrifugal field is shown generally at 10 as an air-sparged hydrocyclone. The body of hydrocyclone 10 is configurated generally as a conventional hydrocyclone having an upper, cylindrical section 12 and terminating at its lower end in a downwardly directed cone 18 with an underflow apex 20 for underflow 44. A vortex finder 28 is inserted into cylindrical section 2 and provides an outlet for an overflow product 32 through an outlet 30. A feed inlet 24 introduces a slurry feed 38 tangentially into cylindrical section 12 to thereby create the cyclonic action therein. A section 22 changes the inlet 23 from a circular cross-section to the rectangular cross-section for inlet 24.

A porous wall 42 is formed as a wall for a portion of hydrocyclone 10. Porous wall 42 is surrounded exteriorly by an air plenum 40 formed by a cylindrical wall 17 extending between an upper flange 15 and a lower flange 16. An air inlet 34 admits air 36 under pressure into air plenum 40.

Figure 3:
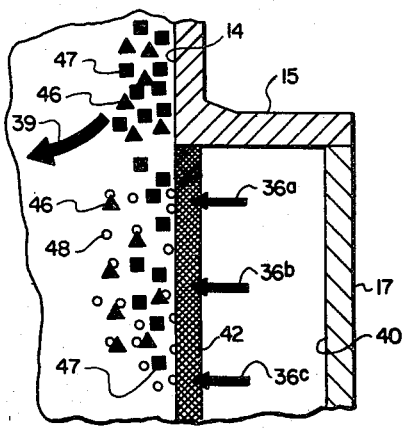
FIG. 3 is an enlarged, schematic representation of a fragment of FIG. 1 to illustrate the novel process of this invention of flotation in a centrifugal field.

With particular reference also to FIG. 3, air 36 in air plenum 40 is shown schematically as arrows **36*a*–36*c* penetrating porous wall 42 and becoming a plurality of discrete air bubbles 48. The slurry feed 38 includes a plurality of hydrophobic particles 46 and hydrophilic particles 47 traveling in a counterclockwise cyclonic action as indicated schematically by arrow 39. Air bubbles 48 attach themselves under known, conventional flotation techniques and are carried inwardly toward the center vortex of hydrocyclone 10 where they are carried upwardly through the overflow outlet 30 as overflow 32. Importantly, it should be clearly understood that hydrophobic particles 46 are illustrated schematically herein for ease of illustration and presentation. With particular reference to Equation 1 further in combination with Table I, it will be observed that both the bubble numbers (N), and the average bubble velocity (u) in a centrifugal field of approximately 80 G should be sufficient to provide a surprisingly improved flotation of particles 46 thereby substantially extending the curves of FIG. 1** to the left so that recovery of a significantly smaller particle size will be achieved.

Figure 4:
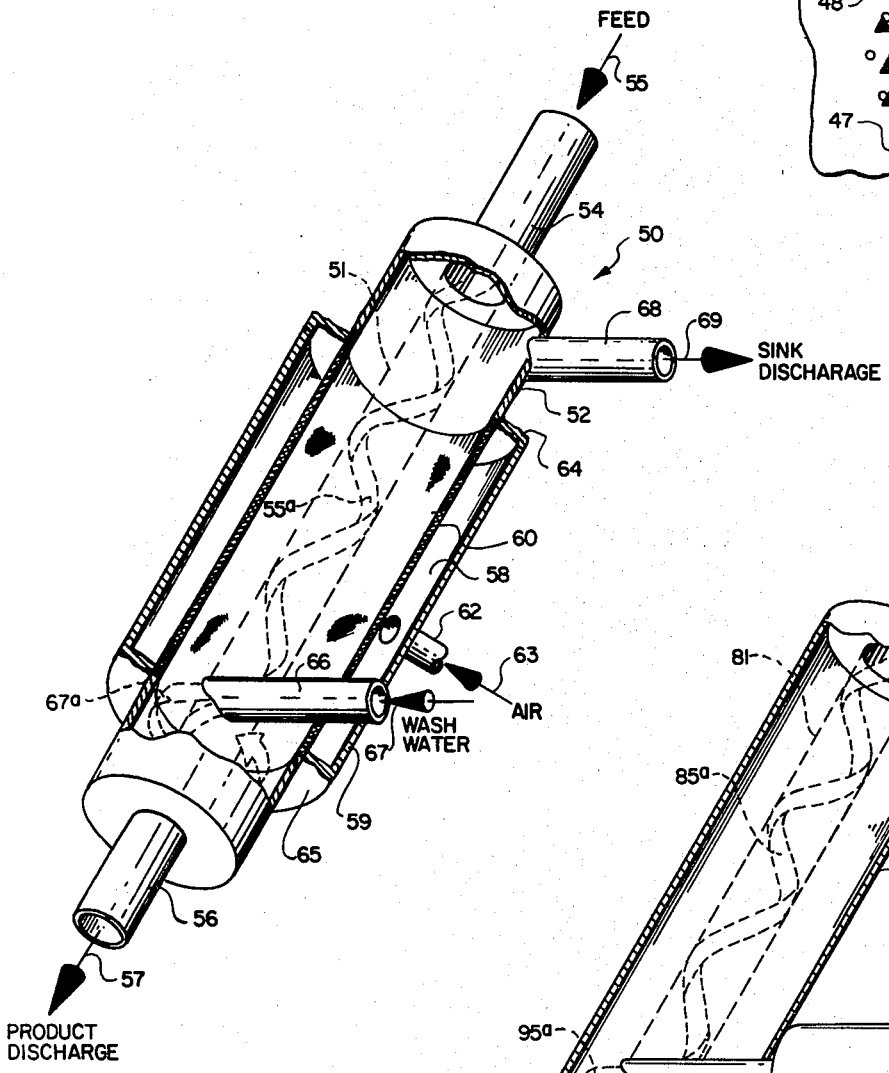
FIG. 4 is a second preferred embodiment of the novel apparatus of this invention for obtaining flotation in a centrifugal field with portions broken away to reveal internal construction and operation.
Figure 5:
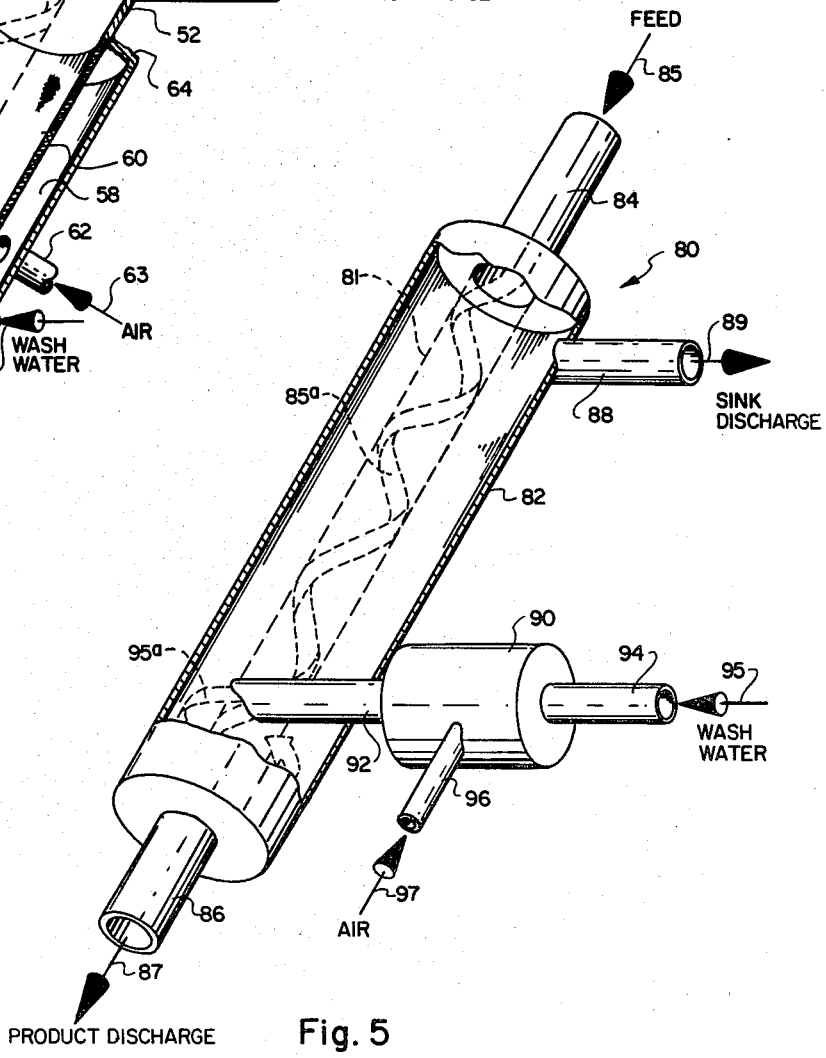
FIG. 5 is a third preferred embodiment of the novel apparatus of this invention for obtaining flotation in a centrifugal field with portions broken away to reveal internal construction and operation.

The foregoing principles with respect to FIG. 3, although presented herein with respect to the first preferred embodiment illustrated in FIG. 2, are clearly applicable throughout this discussion and also particularly with respect to the second and third preferred embodiments of this invention shown in FIGS. 4 and 5, respectively.

The Embodiment of FIG. 4

Referring now more particularly to FIG. 4, a second preferred embodiment of the novel apparatus of this invention for achieving flotation in a centrifugal field is shown generally at 50 and includes a cylindrical vessel 52 having a coaxial inlet 54 for a feed 55 at an upper end and a coaxial outlet 56 for a product discharge 57 at the lower end. A portion of the external wall of vessel 52 is formed as a porous wall 60 which is surrounded by an air plenum 58 formed by a cylindrical wall 59 cooperating between upper and lower flanges 64 and 65, respectively. An air inlet 62 provides access for pressurized air 63 into air plenum 58.

Cyclonic action in vessel 52 is created by a tangentially arrayed wash water inlet 66 for wash water 67 under pressure. Wash water 67 entering vessel 52 rotates in a counterclockwise direction as indicated schematically by broken arrow **67*a* and travels upwardly through the interior of vessel 52 to a second tangential outlet, sink discharge outlet 68 where it becomes sink discharge 69. The cyclonic action of wash water 67 as shown by broken arrow 67*a* creates a corresponding vortex for feed 55 thereby resulting in the more dense particles in feed 55 being carried over by wash water 67 to sink discharge 69. Lighter particles continue with feed 55 in an inner vortex, indicated schematically at broken line 55*a*, are discharged through outlet 56 as product discharge 57. The general transition line between the two vortices is shown schematically by broken line 51**.

Referring also to the discussion hereinbefore with respect to the schematically illustrated process of FIG.

3, air 63 passing into air plenum 58 is directed through porous wall 60 thereby forming a plurality of discrete bubbles (schematically similar to bubbles 48, FIG. 3) to achieve the novel flotation process in a centrifugal field of this invention.

The Embodiment of FIG. 5

Referring now more particularly to FIG. 5, a third preferred embodiment of the novel apparatus of this invention for achieving flotation in a centrifugal field is shown as cyclonic flotation separator 80. Cyclonic flotation separator 80 is configurated as a cylindrical vessel 82 having a coaxial, feed inlet 84 at an upper end for a feed stream 85 and a corresponding, coaxial outlet 86 at a lower end for product discharge 87. Cyclonic action in vessel 82 is created by wash water 95 being tangentially introduced into vessel 82 by a tangential inlet 92. The flow pattern thus created is schematically illustrated at broken lines 95*a* as a cyclonic vortex. The cyclonic vortex in vessel 82 directs wash water 95 upwardly through vessel 82 to discharge outlet 88 as sink discharge 89. The corresponding cyclonic action of feed 85 as generated by wash water 95 is shown at vortex 85*a* (shown in broken lines) with the region between the vortices being indicated generally with broken lines as column 81. Air, indicated schematically at arrow 97, is introduced through an inlet 96 into a mixer 90 where it is intimately blended as a fine dispersion of bubbles (see bubbles 48, FIG. 3) in wash water 95. Mixer 90 can be of any suitable configuration and may include, for example, an externally-powered mixing apparatus for achieving the fine dispersion of bubbles 48 (FIG. 3) in the process. Alternatively, gas bubbles 48 (FIG. 3) may be generated electrolytically or by any other suitable process.

The invention may be embodied in other specific forms without departing from its spirit or essential characteristics. The described embodiments are to be considered in all respects only as illustrative and not restrictive and the scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. A flotation apparatus for obtaining separation of fine particles in a centrifugal field comprising:
   - a chamber having a generally circular cross-section and receiving a particulate suspension therein, a substantial portion of the particles in the particulate suspension being fine particles and at least a portion of the particles in the particulate suspension being hydrophobic;
   - inlet means for introducing a fluid under pressure into the chamber, said fluid being introduced in a generally tangential fashion thereby creating a vortex in the chamber, the vortex forming a centrifugal field;
   - a porous wall forming at least a portion of the outer wall of the chamber, said porous wall being capable of introducing gas in finely dispersed bubbles into the vortex of said chamber, said gas forming bubble/particle aggregates with the hydrophobic particles in the particulate suspension and said bubble/particle aggregates being floated towards the core of the chamber and there collecting to form a froth phase within the core of the chamber, thereby achieving separation of said hydrophobic particles by flotation in the centrifugal field;
   - a gas plenum enclosing the porous wall portion of the outer wall of the chamber, said gas plenum supplying the gas introduced through the porous wall into the chamber; and
   - a vortex finder for directing the froth phase out of the chamber, said vortex finder being positioned at an upper end of the chamber and oriented coaxially with the chamber, said vortex finder having a substantially reduced cross-sectional area as compared to the chamber.

2. The flotation apparatus defined in claim 1 wherein the chamber comprises a vertically oriented, cylindricoconical vessel having a cylindrical section adjacent the inlet means and tapering downwardly into a frustoconical section.

3. The flotation apparatus defined in claim 1 wherein the fluid is introduced into the chamber at a flow rate sufficient to create a centrifugal field in the range of about 80 G in the chamber.

4. The flotation apparatus defined in claim 1 wherein the chamber comprises a cylindrical vessel.

5. A method for separating fine hydrophobic particles by flotation in a centrifugal field comprising:
   - introducing a fluid suspension of particles coaxially into a cylindrical vessel at a first end, a substantial portion of the particles in the fluid suspension being fine particles and at least a portion of the particles in the fluid suspension being hydrophobic;
   - creating a vortex in the vessel by introducing a second fluid into the vessel adjacent a second end in a generally tangential fashion and removing fluid from the vessel adjacent the first end in a generally tangential fashion, the vortex forming a centrifugal field in the vessel;
   - sparging gas through a porous wall formed in at least a portion of the outer wall of the vessel, the gas forming finely dispersed bubbles which form bubble/particle aggregates with the hydrophobic particles in the fluid suspension;
   - floating said bubble/particle aggregates towards the core of the vessel; and
   - collecting the bubble/particle aggregates at the core of the vessel to create a froth phase, thereby achieving separation of said hydrophobic particles by flotation in the centrifugal field.

6. The method as defined in claim 5 further comprising the step of removing the froth phase coaxially from the vessel at the second end.

7. A flotation apparatus for obtaining separation of fine particles in a centrifugal field comprising:
   - a chamber having a generally circular cross-section;
   - a coaxial inlet at a first end of the chamber for introducing a particulate suspension into the chamber, a substantial portion of the particles in the particulate suspension being fine particles and at least a portion of the particles in the particulate suspension being hydrophobic;
   - a coaxial outlet at a second end of the chamber for removing a froth phase from the chamber, said coaxial outlet having a substantially reduced cross-sectional area as compared to the chamber;
   - means for introducing a fluid under pressure into the chamber, said fluid being introduced in a generally tangential fashion thereby creating a vortex in the chamber, the vortex forming a centrifugal field;

a porous wall forming at least a portion of the outer wall of the chamber, said porous wall being capable of introducing gas in finely dispersed bubbles into the vortex of said chamber, said gas forming bubble/particle aggregates with the hydrophobic particles in the particulate suspension and said bubble/particle aggregates being floated towards the core of the chamber and there collecting to form the froth phase within the core of the chamber, thereby achieving separation of said hydrophobic particles by flotation in the centrifugal field; and a gas plenum enclosing the porous wall portion of the outer wall of the chamber, said gas plenum supplying the gas introduced through the porous wall into the chamber.

8. The flotation apparatus defined in claim 7 wherein the chamber comprises a generally cylindrical vessel.

9. The flotation apparatus defined in claim 8 wherein said fluid introducing means comprises a generally tangential inlet adjacent said second end and a generally tangential discharge adjacent said first end.

10. The flotation apparatus defined in claim 9 wherein said fluid introducing means comprises a generally tangential inlet adjacent said first end and a generally tangential discharge adjacent said second end.

11. An air-sparged hydrocyclone comprising:

a generally cylindrical vessel;

a coaxial feed at a first end of the vessel for receiving a particulate suspension into the vessel, a substantial portion of the particles in the particulate suspension being fine particles and at least a portion of the particles in the particulate suspension being hydrophobic;

a coaxial discharge at a second end of the vessel for allowing removal of a froth phase from the vessel, said coaxial discharge having a substantially reduced cross-sectional area as compared to the vessel;

an inlet means for introducing a washing medium into the vessel, the inlet means being located adjacent and generally tangential to the second end of the vessel;

an outlet means for removing particles and washing medium from the vessel, the outlet means being located adjacent and generally tangential to the first end of the vessel;

a porous wall forming at least a portion of the outer wall of the vessel between the inlet means and the outlet means, said porous wall being capable of introducing air in finely dispersed bubbles into the vessel, the air forming bubble/particle aggregates with the hydrophobic particles in the particulate suspension and said bubble/particle aggregates being floated towards the core of the vessel and there collecting to form the froth phase within the core of the vessel, thereby achieving separation of the hydrophobic particles by flotation in a centrifugal field; and an air plenum enclosing the porous wall portion of the outer wall of the vessel.

12. A method for separating fine particles in a fluid suspension of particles comprising:

obtaining a vessel having a circular cross-section;

forming a porous wall in at least a portion of the outer wall of the vessel;

enclosing the porous wall in a gas plenum;

introducing a feed into the vessel, the feed including particles in a fluid suspension, a substantial portion of said particles being fine particles and at least a portion of said particles being hydrophobic;

providing an outlet means for removing a material from the vessel;

creating a centrifugal field in the vessel by creating a vortex in the vessel;

sparging gas from the gas plenum through the porous wall and into the vortex, said gas forming finely dispersed bubbles which form bubble/particle aggregates with the hydrophobic particles in the fluid suspension; and floating said bubble/particle aggregates towards the core of the vessel and there collecting the bubble/particle aggregates to form a froth phase within the core of the vessel, thereby achieving separation of said hydrophobic particles by flotation in the centrifugal field.

13. The method defined in claim 12 wherein the obtaining step comprises preparing said vessel with a cylindrical section and a conical section and orienting said vessel in a vertical orientation with said conical section providing a downward taper to the vessel.

14. The method defined in claim 13 wherein said creating step further comprises creating said vortex and said centrifugal field in said vessel by injecting said feed into said cylindrical section of said vessel in a generally tangential fashion.

15. The method defined in claim 12 wherein the obtaining step comprises preparing said vessel as a cylindrical chamber.

16. The method defined in claim 15 wherein the introducing step further comprises introducing said feed into said vessel through a coaxial inlet and said creating step further comprises creating said centrifugal field by injecting a second fluid into the vessel in a generally tangential fashion.

17. The method defined in claim 12 further comprising the step of removing the froth phase coaxially from the vessel through a vortex finder positioned at an upper end of the vessel, said vortex finder having a substantially reduced cross-sectional area as compared to the vessel.

18. The method defined in claim 12 wherein the feed is introduced into the vessel at a flow rate sufficient to create a centrifugal field in the range of about 80 G in the vessel.

19. A gas-sparged hydrocyclone for obtaining separation of fine particles in a centrifugal field comprising:

a vertically oriented chamber, the chamber having a circular cross-section;

inlet means for introducing a particulate suspension comprising hydrophobic particles into the chamber, a substantial portion of the particles in the particulate suspension being fine particles, the inlet means comprising a generally tangential entry and the tangential entry imparting a vortex flow to the particulate suspension, thereby creating a centrifugal field in the chamber;

an overflow means for directing a froth phase out of the chamber, the overflow means comprising a vortex finder located at an upper end of the chamber and oriented coaxially with the chamber, said vortex finder having a substantially reduced cross-sectional area as compared to the chamber;

an outlet means for removing an underflow product from the chamber, the outlet means comprising a discharge outlet at a lower end of the chamber and oriented coaxially with the chamber; and gas sparging means for introducing a gas into the chamber comprising a gas plenum surrounding the chamber and a porous wall between the gas plenum and the chamber for introducing gas from the gas plenum into the chamber, the gas forming finely dispersed bubbles which form bubble/particle aggregates with the hydrophobic particles in the particulate suspension, said bubble/particle aggregates being floated towards the core of the chamber and there collecting to form the froth phase within the core of the chamber, thereby achieving separation of said hydrophobic particles by flotation in the centrifugal field.

20. The gas-sparged hydrocyclone defined in claim 19 wherein the chamber comprises an upper cylindrical section and a lower downwardly tapered conical section.

* * * * *

UNITED STATES PATENT AND TRADEMARK OFFICE

CERTIFICATE OF CORRECTION

PATENT NO. : 4,399,027

DATED : August 16, 1983

INVENTOR(S) : Jan D. Miller

It is certified that error appears in the above—identified patent and that said Letters Patent is hereby corrected as shown below:

Column 2, line 45, "characteristics" should be --characteristic--

Column 5, line 63, "appendent" should be --appended--

Column 7, line 63, "section 2" should be --section 12--

Signed and Sealed this

*Thirteenth* Day of *December 1983*

[SEAL]

*Attest:*

GERALD J. MOSSINGHOFF

*Attesting Officer*

*Commissioner of Patents and Trademarks*